US007607988B1

(12) United States Patent
Laiacona

(10) Patent No.: US 7,607,988 B1
(45) Date of Patent: Oct. 27, 2009

(54) GOLF ALIGNMENT AND TARGETING SYSTEM

(76) Inventor: Matthew Thomas Laiacona, 59 Asbury Rd., Hackettstown, NJ (US) 07840

( * ) Notice: Subject to any disclaimer, the term of this patent is extended or adjusted under 35 U.S.C. 154(b) by 0 days.

(21) Appl. No.: 12/314,792

(22) Filed: Dec. 17, 2008

(51) Int. Cl.
*A63B 69/36* (2006.01)

(52) U.S. Cl. ..... 473/268; 473/257; 473/409

(58) Field of Classification Search ..... 473/218, 473/219, 226, 228, 229, 257, 266, 268, 409
See application file for complete search history.

(56) References Cited

U.S. PATENT DOCUMENTS 2,025,519 A 12/1935 Lingg
2,169,407 A 8/1939 Crowley
5,275,570 A 1/1994 Hicks
5,415,407 A 5/1995 Hayden
5,611,738 A 3/1997 Lundquist
5,616,085 A 4/1997 LaCoste et al.
5,665,008 A 9/1997 Chaney
6,955,610 B1 * 10/2005 Czaja et al. ..... 473/256
7,115,043 B2 * 10/2006 Leadbetter et al. ..... 473/257

* cited by examiner

*Primary Examiner*—Nini Legesse
(74) *Attorney, Agent, or Firm*—Thomas J. Geminario

(57) ABSTRACT

A golf alignment and targeting aid is a simple, durable, lightweight and easily portable device which provides golfers with a straight, clear and accurate view of their target by allowing the golfer to visualize the target several feet in front of the golf ball, eliminating the need for the golfer to visualize targets that vary in great distances, and enabling the golfer to keep his/her head down without the need to look up toward the target.

3 Claims, 7 Drawing Sheets

GOLF ALIGNMENT AND TARGETING SYSTEM

BACKGROUND OF THE INVENTION

The present invention generally relates to devices and methodologies that assist in aiming projectiles at specific targets, and specifically to such targeting aids as applied to sporting activities, such as golf.

Every shot in golf requires proper alignment which establishes the necessary swing path. Alignment involves the proper positioning of the body in order to execute an accurate shot. The club shaft plane is created by gripping the club and placing the club head on the playing surface behind the ball. Preparation for the shot is achieved through aiming at an intended target then positioning the club and body relative to the ball with proper alignment.

There are numerous golf training systems and various devices which can be found in the prior art, which are available to assist the golfer in developing both proper alignment and proper swing path. Several very early patents disclose golfer stance gauges for teaching proper stance, angle and position of the feet with relation to the golf ball. Representative of these are U.S. Pat. Nos. 2,025,519 and 2,169,407.

U.S. Pat. No. 5,415,407 relates to a golf training method which involves placing two strips in parallel arrangement and a third strip in perpendicular arrangement. The golfer positions him/herself on one of the strips so that he/she faces the golf ball with one foot on each side of the perpendicular strip.

U.S. Pat. No. 5,616,085 discloses a swing training aid having an elongated stance member. A golf ball positioner is carried by the stance positioning member. A swing guide at the end of the golf ball positioner has a generally triangular shape. The swing guide is relatively small and is provided to assist the golfer in club movement extending a short distance on either side of the ball.

U.S. Pat. No. 5,611,738 teaches a stance alignment device in the form of a substantially flat mat designed to align a golfer's feet with respect to the intended flight path of the golf ball. U.S. Pat. No. 5,275,570 discloses a golf instructional aid that is a generally U-shaped, flat frame, having a V-shaped base and two parallel arms forming an open gate. The device is intended as a golf instructional aid which allows the golfer to practice the golf swing with proper stance, ball position and hand position. U.S. Pat. No. 5,665,008 shows a golf training apparatus consisting of a plurality of tubes which can be assembled in various ways to provide training.

From the foregoing patents, which are representative of numerous patents that relate to golf training devices, it can be appreciated that both stance gauges and alignment devices are well known in the prior art. The prior art generally teaches devices consisting of flat panels or rods, which may be positioned on the playing surface in some manner to assist in stance, alignment and ball position. But these devices, while they may be helpful in the mechanics of stance and body alignment, do not aid in the actual visual alignment and targeting of a golf shot from an immediate, direct and concrete perspective.

Many golf instructors will utilize various mental techniques to assist a student in visually aligning a golf shot. One such method is to imagine a line starting from the golf ball extending down the golf ball path to the intended target. However, the visualization of such an imaginary line is often difficult for golfers because of the great distances that are involved. Moreover, such visualization tends to distract the golfer's attention from the golf ball to the target, thereby inducing him/her to lift his/her head during the swing and/or to take his/her eyes off the ball.

A review of the prior art demonstrates that there exists an unfulfilled need for a device that aids golfers in alignment and targeting visualization without interfering with the proper mechanics of the golf swing. In addition, there exists the need for an aid that will allow the golfer to perceive the target from directly behind the golf ball rather than from the side of the golf ball, as prior art generally does. Furthermore, there exists the need for a simple device that is durable, lightweight and easily portable.

SUMMARY OF THE INVENTION

An objective of the present invention is to provide an aid to golfers in alignment and aiming that will allow the golfer to visualize the proper path of the ball to the target without lifting his/her head or taking his/her eye off the ball.

Another objective is to provide a targeting aid that provides a straight, clear and accurate view of a golfer's target.

A further objective is to provide a target sight disc several feet in front of a golfer's golf ball, so that the golfer does not have to visualize an imaginary line of the intended golf ball path that will vary in great distances.

An additional objective is to provide an alignment and targeting visualization aid that will reduce the amount of golf balls used during a golf game by reducing the strokes needed to complete the game.

A further objective is to provide an alignment and targeting visualization aid that is simple, durable, lightweight and easily portable.

A still further objective is to provide an alignment and targeting visualization aid that is cost effective and inexpensive to manufacture.

These and other related beneficial objectives are achieved by the preferred embodiment of the present invention as described below and illustrated in the accompanying drawings. Attention is called, however, to the fact that the detailed description and drawings are illustrative only, and that changes may be made in the specific construction illustrated and described within the scope of the appended claims.

DETAILED DESCRIPTION OF THE PREFERRED EMBODIMENT

Figure 1:
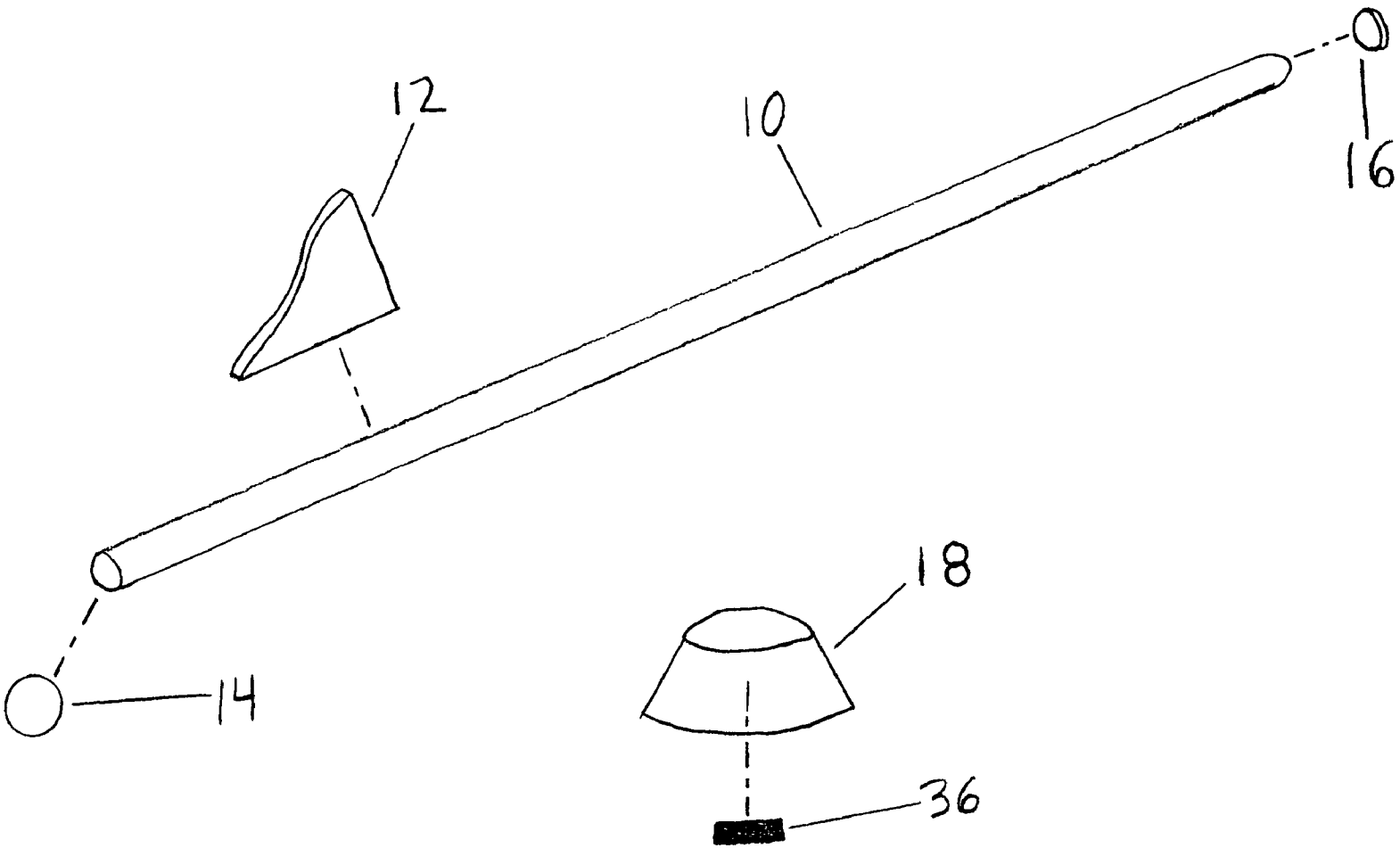
FIG. 1 is an exploded perspective view of the alignment and targeting aid.

FIG. 1 depicts an exploded perspective view of a golf alignment and targeting aid that constitutes the preferred embodiment of the present invention. As depicted in FIG. 1, the golf alignment and targeting aid comprises a shaft 10, a sight 12, a tip 14, a top piece 16, and a target sight disc 18. The shaft 10 is an elongated rod having approximately the same length and diameter as that of a golf club shaft. The shaft 10 is made of a rigid, light-weight material, such as wood or plastic. To the distal end of the shaft 10 is fixedly attached the tip 14, which is a disc-shaped piece of magnetic material, such as iron or steel. Along the side of the shaft 10 in close proximity to tip 14 is fixedly attached the sight 12, which is a vane-shaped flat extended surface that broadens from its distal to its proximal end. The sight 12 is made of a rigid, light-weight material, such as wood or plastic. To the proximal end of the shaft 10 is fixedly attached the top piece 16, which is a disc-shaped piece of magnetic material, such as iron or steel.

Figure 2:
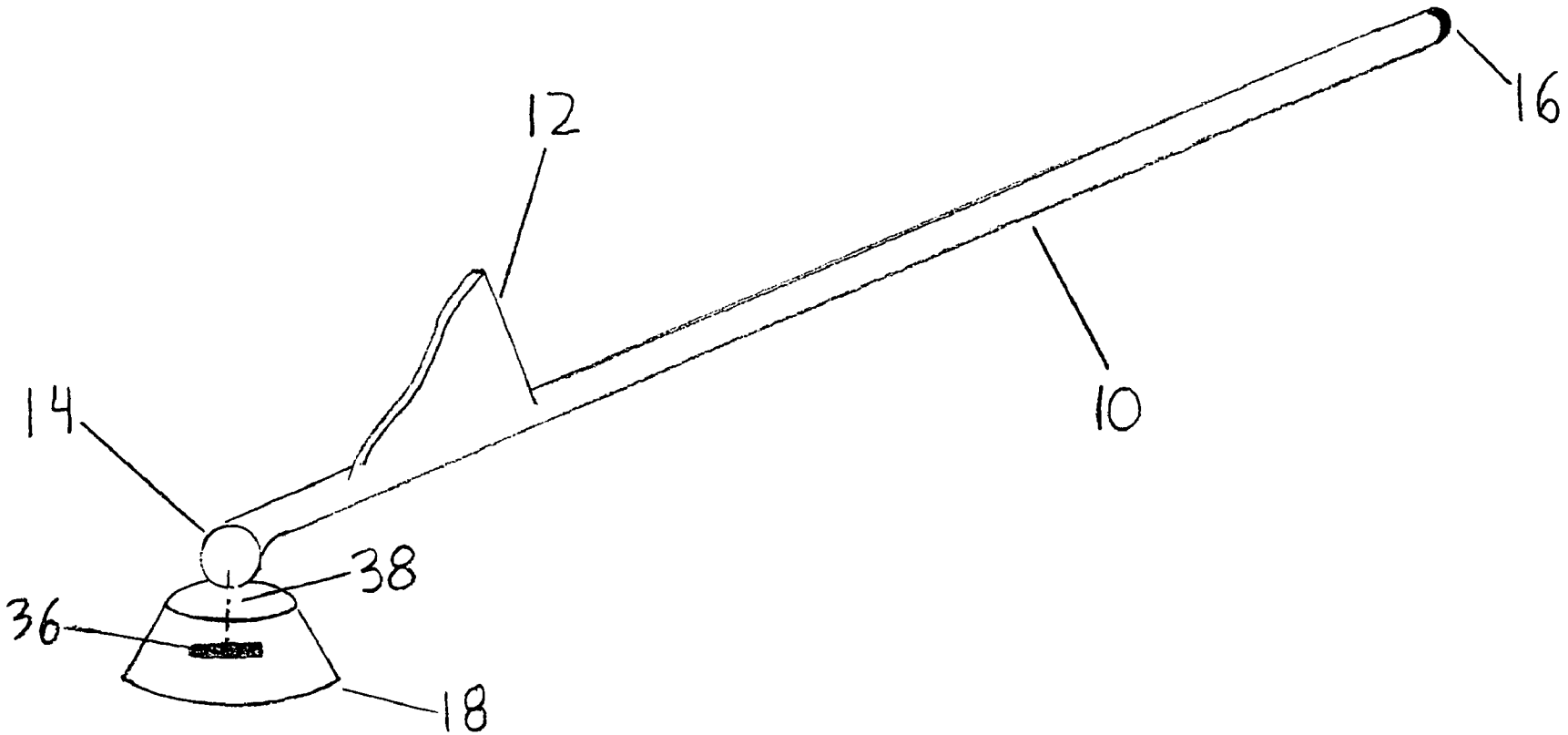
FIG. 2 is a perspective view of the alignment and targeting aid with the target sight disc mounted on the tip in a configuration ready for use.
Figure 7:
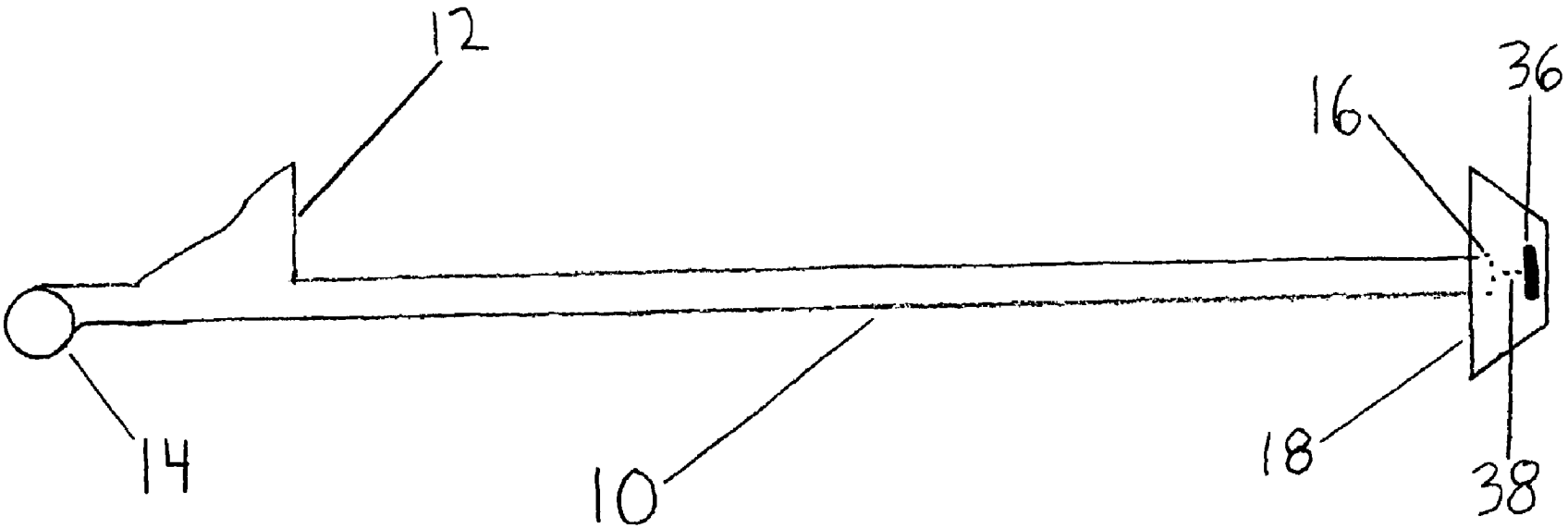
FIG. 7 is a side elevation view of the alignment and targeting aid with the target sight disc mounted on the top piece in a configuration ready for storage.

The target sight disc 18 is a compact, durable object having the configuration of a polyhedron, cylindrical disc, cone or frustum with a broad, flat base, such that it maintains a stable position when placed on a substantially flat surface. Within the target sight disc 18 is an embedded magnet 36. As shown in FIG. 2 and FIG. 7, the target sight disc 18 is removably attachable to either the tip 14 or the top piece 16 through the magnetic attraction between the embedded magnet 36 and the magnetic material comprising the tip 14 and the top piece 16.

Figure 3:
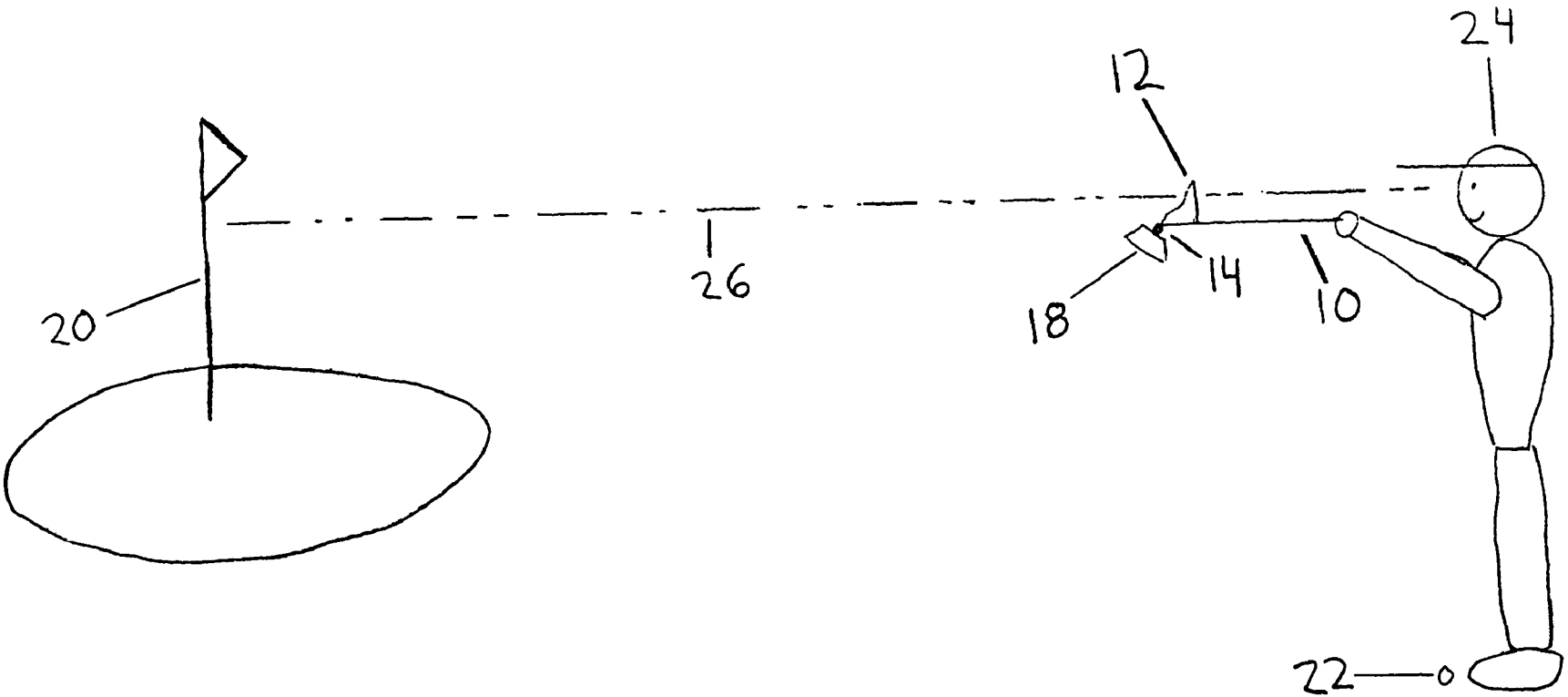
FIG. 3 shows a golfer aligning a shot using the alignment and targeting aid.

FIGS. 2-6 illustrate the method of using the golf alignment and targeting aid to align and aim a golf shot. As shown in FIG. 2, the target sight disc 18 is first removably attached to the tip 14 through the magnetic attraction between the embedded magnet 36 and the magnetic material comprising the tip 14. As shown in FIG. 3, a golfer 24 then positions him/herself on a ground behind a golf ball 22 so as to establish a straight and unobstructed sight line 26 to a target 20. Next, the golfer 24 grasps the shaft 10 by its proximal end and raises it so that the sight 12 is aligned with the sight line 26 to the target 20.

Figure 4:
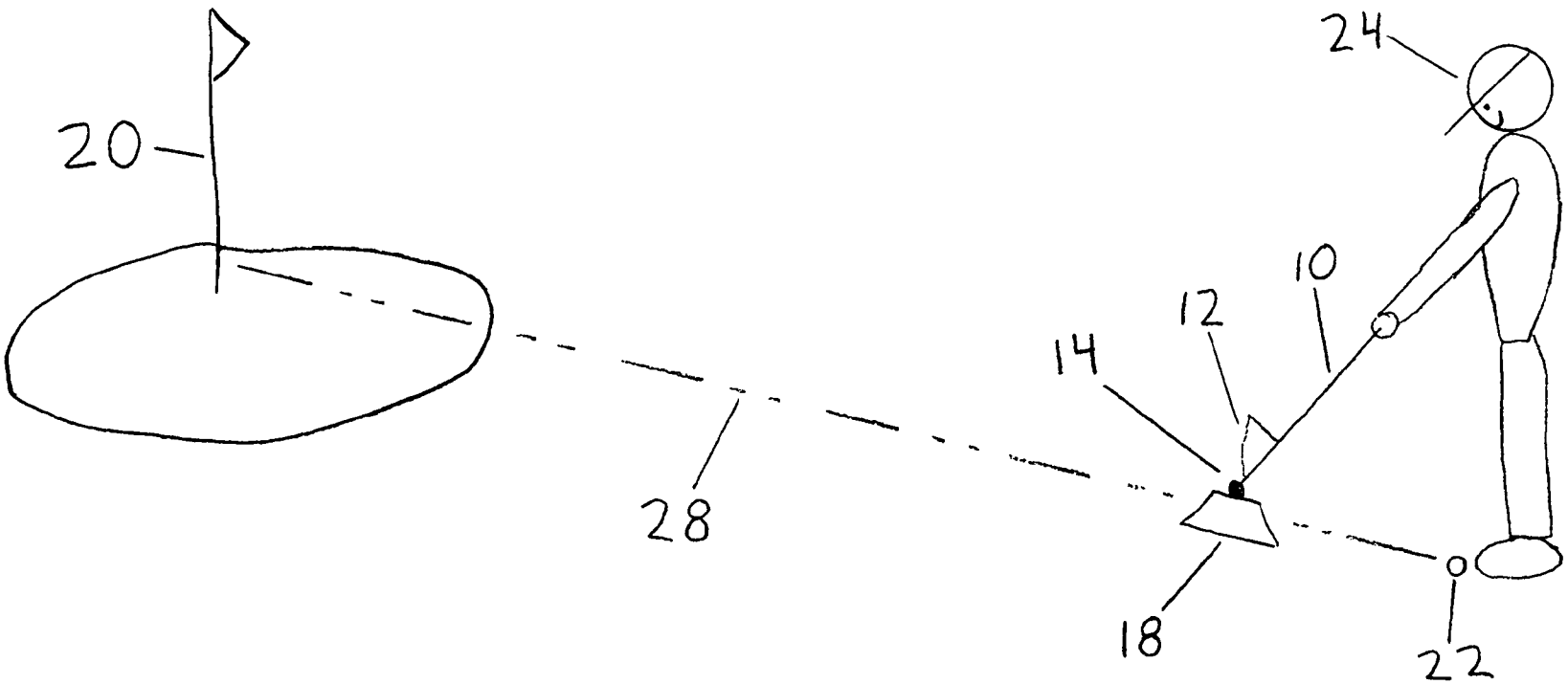
FIG. 4 shows a golfer placing the target sight disc on the ground.
Figure 5A:
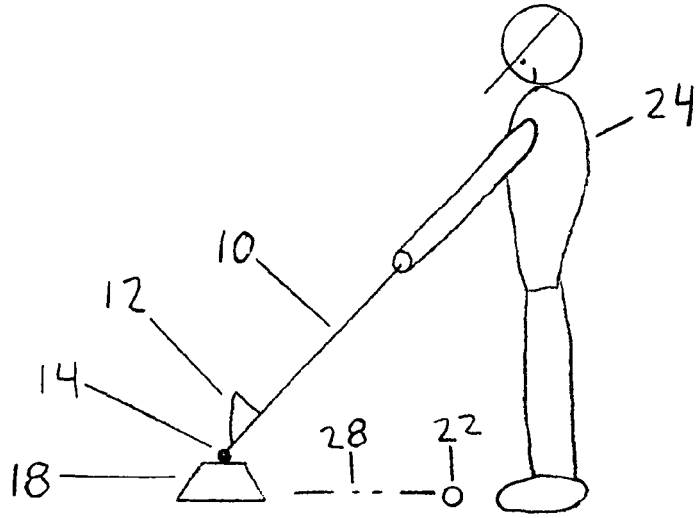
FIGS. 5A, 5B, 5C show a golfer removing the target sight disc from the tip of the alignment and targeting aid.
Figure 5B:
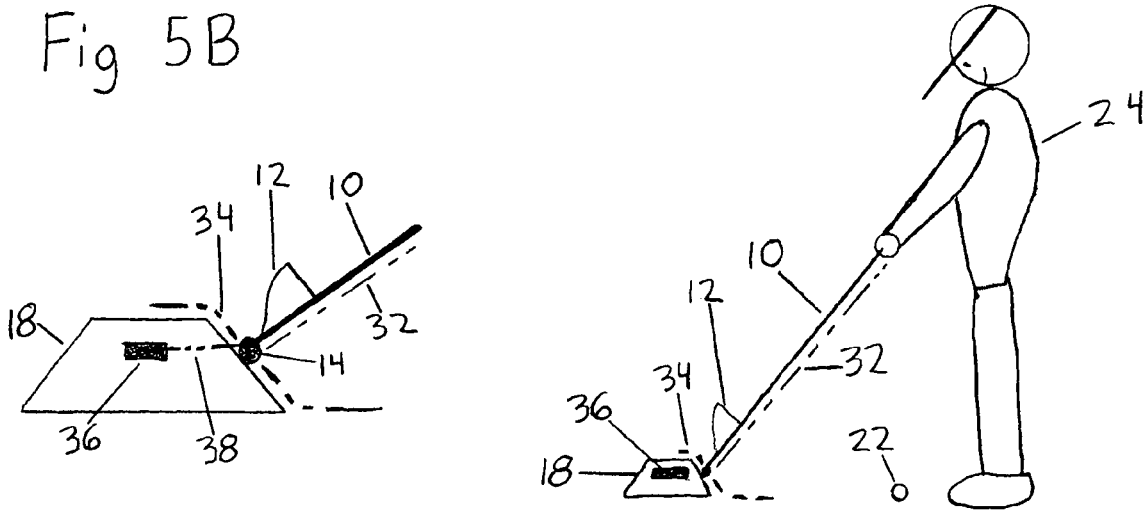
Figure 5C:
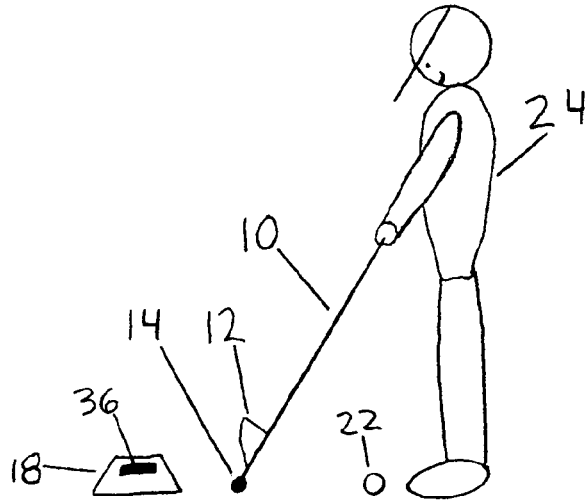

As depicted in FIG. 4, the golfer 24 then lowers the shaft 10 through the plane formed by the sight line 26 and the golf ball 22, which plane intersects the ground to form a target line 28 between the target 20 and the golf ball 22. The golfer 24 lowers the shaft 10 to the point at which the target sight disc 18 rests on ground along the target line 28. As depicted in FIGS. 5A, 5B and 5C, the target sight disc 18 is next detached from the tip 14 by sliding the tip 14 downward along the surface of the target sight disc 18 until it reaches the ground and separates from target sight disc 18 and is clear of the attraction of the embedded magnet 36.

As seen in FIG. 5B, during the process of sliding 34 the tip 14 off the top and down the side of the target sight disc 18, the golfer 24 must apply a light downward pressure 32 onto the target sight disc 18 so that the target sight disc 18 will stay in its proper position on the ground along the target line 28 while being detached from the tip 14. The pressure 32 is applied by pushing down on the shaft 10, which in turn applies pressure 32 down the shaft 10 to the tip 14 and onto the target sight disc 18, such that the target sight disc 18 is held in its proper position on the ground, while allowing the tip 14, as seen in FIG. 5C, to slid 34 away free and clear from the magnetic attraction 38 of the embedded magnet 36 within the target sight disc 18.

Figure 6:
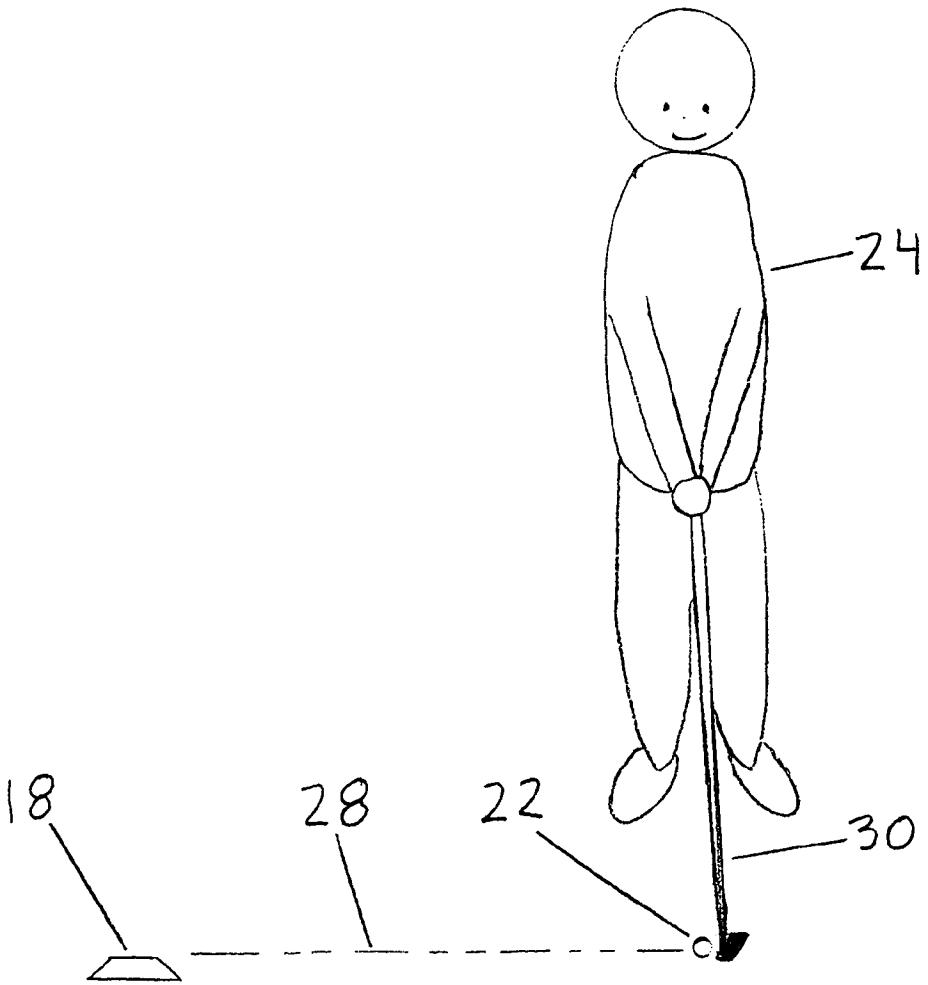
FIG. 6 shows a golfer aligned for a golf swing using the golf ball, target sight disc and target line.

As shown in FIG. 6, once the target sight disc 18 is detached from the tip 14, the golfer 24 sets the golf alignment and targeting aid aside and uses a golf club 30 to stroke the golf ball 22 toward the target 20 along the target line 28 as it extends from the target sight disc 18 to the golf ball 22. This obviates the need to rely on an imaginary line starting from the golf ball 22, extending down the golf ball path to the intended target 20, which will vary in great distances. It also obviates the need for the golfer 24 to look up toward the target 20 while he/she is aligning the shot, thus enabling the correct "head down, eye on the ball" golf swing.

FIG. 7 depicts the golf alignment and targeting aid in a configuration ready for storage. Once the golfer 24 has finished the above steps and is ready to store the alignment and targeting aid, the golfer 24 simply takes the target sight disc 18 and mounts it onto the top piece 16. The embedded magnet 36 in the target sight disc 18 will magnetically attract 38 and hold the target sight disc 18 to the magnetic material comprising the top piece 16. With its durable, lightweight shaft 10 and its ability to be stored in such a simple manner, the golf alignment and targeting aid will fit anywhere golf clubs are stored or into any golf club bag, making it an easily portable device.

While this invention has been described with reference to a specific embodiment, the description is not to be construed in a limiting sense. Various modifications of the disclosed embodiment, as well other embodiments of the invention, will be apparent to persons skilled in the art upon reference to this description. It is therefore contemplated that the appended claims will cover any such modifications or embodiments that fall within the true scope of this invention.

What is claimed is:

1. A golf alignment and targeting aid comprising:

(a) a shaft, which is an elongated rod made of a rigid, light-weight material, which shaft has a proximal end and a distal end;

(b) a tip, which is a disc-shaped piece of magnetic material rigidly attached to the distal end of the shaft;

(c) a sight, which is a vane-shaped, flat extended surface, having a narrow forward end and a broad back end, wherein sight is made of a rigid, light-weight material, and which sight is rigidly attached to the shaft, such that the sight extends longitudinally along the shaft in close proximity to the tip, and such that the forward end of the sight is oriented toward the distal end of the shaft;

(d) a top piece, which is a disc-shaped piece of magnetic material rigidly attached to the proximal end of the shaft; and (e) a target sight disc, which is a compact, durable object having the configuration of a polyhedron, cylindrical disc, cone or frustum, with a broad, flat base, such that it the target sight disc maintains a stable position when placed on a substantially flat surface, wherein target sight disc has an exterior surface and an interior volume, wherein interior volume contains an embedded magnet, whereby the target sight disc is removably attachable to either the tip or the top piece by means of a magnetic attraction between the embedded magnet and either the tip or the top piece.

2. A method of aligning and targeting a golf shot, comprising the following steps:

(a) providing a golf alignment and targeting aid comprising: (i) a shaft, which is an elongated rod made of a rigid, light-weight material, which shaft has a proximal end and a distal end; (ii) a tip, which is a disc-shaped piece of magnetic material rigidly attached to the distal end of the shaft; (iii) a sight, which is a vane-shaped, flat extended surface, having a narrow forward end and a broad back end, which sight is made of a rigid, light-weight material, and wherein sight is rigidly attached to the shaft, such that the sight extends longitudinally along the shaft in close proximity to the tip, and such that the forward of the sight is oriented toward the distal end of the shaft; (iv) a top piece, which is a disc-shaped piece of magnetic material rigidly attached to the proximal end of the shaft; and (v) a target sight disc, which is a compact, durable object having the configuration of a polyhedron, cylindrical disc, cone or frustum, with a broad, flat base, such that the target sight disc maintains a stable position when placed on a substantially flat surface, wherein target sight disc has an exterior surface and an interior volume, wherein interior volume contains an embedded magnet, whereby the target sight disc is removably attachable to either the tip or the top piece by means of a magnetic attraction between the embedded magnet and either the tip or the top piece;

(b) providing a golf club, a golf course ground, a golf ball that lies on the golf course ground, and a target positioned in front of the golf ball;

(c) attaching the target sight disc to the tip through the magnetic attraction between the embedded magnet and the tip;

(d) establishing a straight and unobstructed sight line from a vantage point behind the golf ball to the target;

(e) grasping the shaft by its proximal end and raising it above the golf course ground so that the sight is aligned with the sight line to the target;

(f) lowering the shaft through a plane formed by the sight line and the golf ball, which plane intersects the ground to form a target line between the target and the golf ball, so that the shaft reaches a point at which the target sight disc rests on the golf course ground along the target line;

(g) detaching the target sight disc from the tip by sliding the tip downward along the exterior surface of the target sight disc, while applying light downward pressure on the target sight disc sufficient to hold it in place, until the tip reaches the ground and separates from the target sight disc and is clear of the magnetic attraction of the embedded magnet;

(h) once the target sight disc is detached from the tip, setting the golf alignment and targeting aid aside and using the golf club to stroke the golf ball toward the target by visual orientation along the portion of the target line extending from the target sight disc to the golf ball.

3. The method according to claim 2, comprising the additional step of:

(i) when the golf alignment and targeting aid is not in use, mounting the target sight disc onto the top piece through the magnetic attraction between the embedded magnet within the target sight disc and the top piece, thereby allowing the golf alignment and targeting aid to be readily and compactly stored in a golf bag or other receptacle.

* * * * *